US006136352A

United States Patent [19]

Silverstein et al.

[11] Patent Number: 6,136,352

[45] Date of Patent: Oct. 24, 2000

[54] SANITARY NOVELTY CANDY PRODUCT

[75] Inventors: Scott A. Silverstein, Chappaqua, N.Y.; John Budd, Montclair, N.J.

[73] Assignee: The Topps Company, Inc., New York, N.Y.

[21] Appl. No.: 09/357,420

[22] Filed: Jul. 20, 1999

[51] Int. Cl.[7] ..... B65D 85/60; B65D 83/00; B65D 25/38

[52] U.S. Cl. ..... 426/115; 426/104; 426/110; 401/81; 222/340; 206/817

[58] Field of Search ..... 426/115, 134, 426/110, 104; 401/81, 53, 62, 180; 206/804, 817, 385; 222/340

[56] References Cited

U.S. PATENT DOCUMENTS

| | | | |
|---|---|---|---|
| D. 359,607 | 6/1995 | Yun | 426/115 |
| 1,602,823 | 10/1926 | Kole | 401/81 |
| 1,933,596 | 11/1933 | MacLean | 426/115 |
| 1,976,252 | 10/1934 | YoungHusband | 401/62 |
| 2,287,366 | 6/1942 | YoungHusband | 206/817 |
| 2,335,559 | 11/1943 | YoungHusband | 401/81 |
| 2,491,722 | 12/1949 | Gelardin | 401/81 |
| 2,491,723 | 12/1949 | Gelardin | 401/81 |
| 2,610,732 | 9/1952 | Calhoun | 206/385 |
| 2,704,153 | 3/1955 | Florman | 401/81 |
| 2,789,692 | 4/1957 | Ferri | 401/81 |
| 4,350,712 | 9/1982 | Kocharian et al. | 426/134 |
| 4,914,748 | 4/1990 | Schlotter et al. | 426/104 |
| 5,531,318 | 7/1996 | Coleman et al. | 426/115 |
| 5,874,119 | 2/1999 | Coleman et al. | 426/134 |

*Primary Examiner*—Steve Weinstein
*Attorney, Agent, or Firm*—Darby & Darby

[57] ABSTRACT

A novelty candy product comprises a cylindrical barrel having mounted therein a hard candy portion slidable relative to said barrel. The barrel includes an open mouth end removably covered by a cap which is frictionally or otherwise retained in closing relation of the mouth. The end of the candy portion remote from the mouth carries a valve member which is yieldably urged toward the mouth by a coil spring. The barrel includes, at a position adjacent the mouth, a valve seat. When the cap is removed the coil spring projects the candy through the mouth and the valve into sealing engagement with the valve seat whereby syrups developed in the course of consuming the product are precluded from entering the interior of the barrel.

3 Claims, 2 Drawing Sheets

SANITARY NOVELTY CANDY PRODUCT

BACKGROUND AND FIELD OF INVENTION

Present invention is directed to a sanitary candy product and more particularly to a hard candy portion combined with a dispenser or enclosure which enables the product to be partially consumed and thereafter resealed for subsequent use.

PRIOR ART

The present invention is an improvement of the product identified as "PUSH POP" a registered trademark of The Topps Company, Inc. More specifically, the Push Pop product, which has enjoyed enormous commercial success, is comprised of a polymeric tube. A candy portion is slidably disposed within the tube. The tube, at one end, is open defining a mouth portion through which the candy maybe slidably extended. A cup shaped cap is removably mounted over the mouth portion. The end of the candy remote from the mouth has bonded thereto a plastic disk.

The user removes the cap and manually forces the disk toward the mouth end of the tubular barrel thereby exposing through the mouth a desired increment of the hard candy. The user may consume a portion of the candy and thereafter reclose the container by sleeving the hollow cap over the projecting hard candy portion and forcing the cap toward the end of the barrel remote from the mouth until the cap is seated over the mouth end of the barrel.

A difficulty inherent in the described prior art device resides in the candy portion becoming "frozen" within the barrel in a partially or fully retracted position therein after a portion of the candy is consumed. In the "frozen" condition, the user is unable to access the remainder of the candy.

It has been determined that a principal reason that the candy portion is jammed within the barrel is the leakage into the interior of the barrel around the candy portion of a syrup which is formed of increments of the sugar candy dissolved in the saliva of the user. Unless the disk at the base of the candy portion is tightly advanced during use against an annulus internally of the barrel, the syrup will pass into the interior of the barrel beyond the annulus and solidify after retraction locking the disk and/or candies to the interior of the barrel.

SUMMARY OF THE INVENTION

The present invention maybe summarized as directed to a novelty candy product similar to the Push Pop product which eliminates the drawback of the candy component becoming nonshiftable within the tubular barrel. More particularly, the improved candy product of the present invention includes a spring component interposed between a polymeric wafer or disk bonded to the base of the candy portion and a plug or stop at the end of the barrel remote from the mouth. The disk includes a rim portion which extends radially beyond the candy portion, the outer most margins of the disk forming a valve component.

The barrel includes an interned rim defining a valve seat. The candy component is urged by the spring against portions of the cap which is fictionally mounted over the mouth of the barrel. When the cap is removed, the spring will urge the valve component against the valve seat thereby reliably blocking ingress into the interior of the barrel of syrup generated by the salvia of the user. By this means, the likelihood of the candy portion becoming frozen within the barrel is materially reduced. By minimizing internal leakage of syrup, the product is also rendered more sanitary.

It is accordingly an object of the invention to provide a novelty candy device similar to the Push Pop device which is resistant to the candy portion becoming immovably locked within the barrel of the dispenser.

A further object of the invention is the provision of a novelty candy device of the type described wherein the candy portion springs outwardly when the cap is removed providing a surprise function as well as an efficient seal between the candy carrier disk and an element of the barrel to minimize of eliminate leakage of syrup into the interior of the barrel.

DETAILED DESCRIPTION OF DRAWINGS

Figure 1:
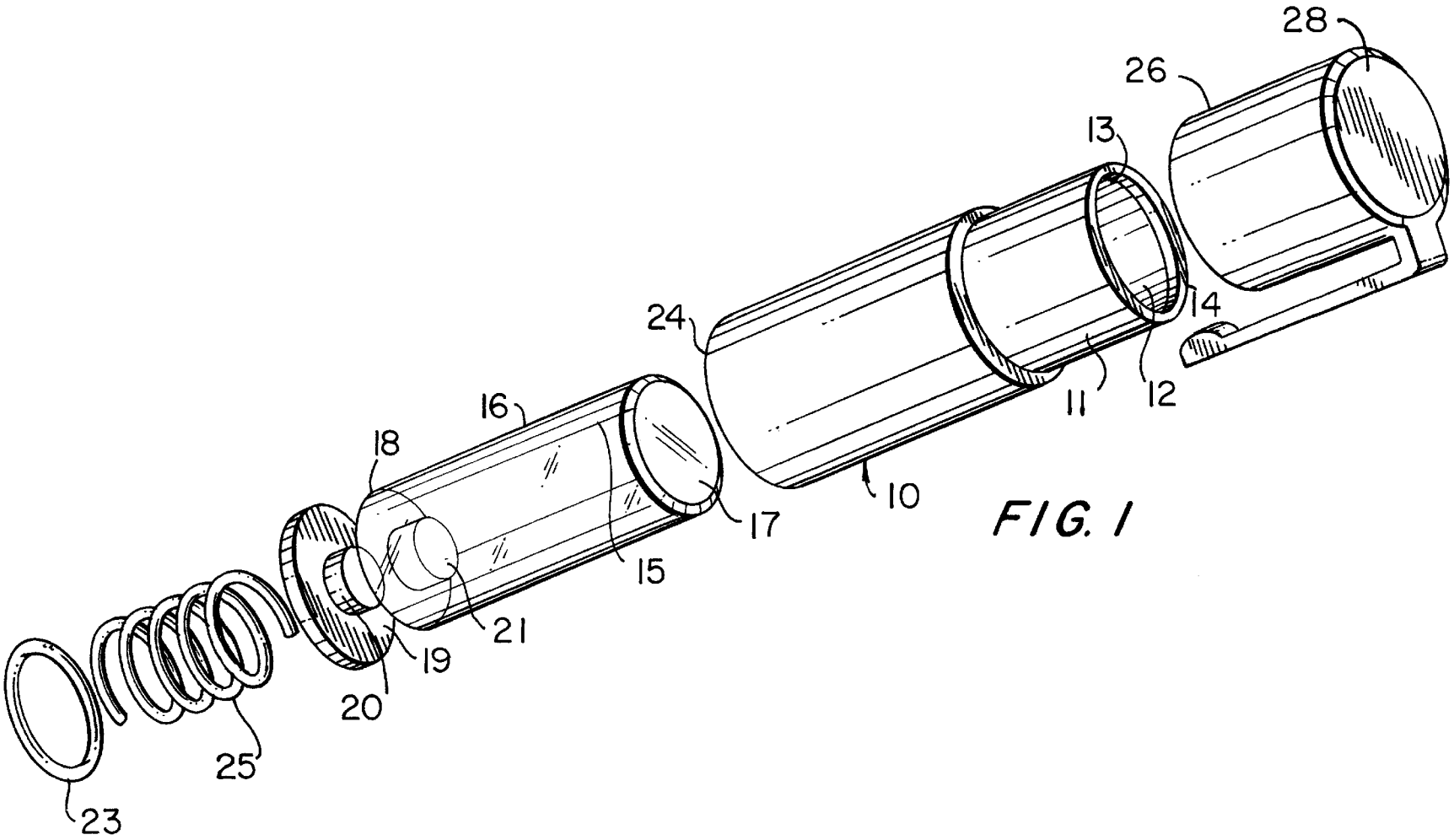
FIG. 1 is an exploded isometric view of the candy device.

Referring now to the drawings, the novelty candy device is comprised of a tubular barrel 11, preferably cylindrical, including a reduced diameter neck portion 11. The interior surface 12 of the barrel is smooth, the barrel preferably being fabricated of rigid polymeric material.

A rim portion 13 projects inwardly adjacent the open mouth 14 of the barrel, the rim 13 functioning as a valve seat. It will be appreciated that the rim 13 may be formed integrally of the barrel or may comprise an insert force fitted or bonded to the interior surface of the barrel adjacent the mouth.

A candy component 15 preferably partially or fully encased in a removable cellophane wrapper 16 includes a leading end 17 and a trailing end 18. A valve 19 in the form of disk is bonded to the trailing edge 18 of the candy portion 15. Preferably, the disk shaped valve member 19 is secured to the candy portion 15 in the course of formation of the candy portion the latter being cast over the valve member. Preferably, in order to assure a firm connection between the valve member and the candy portion the valve includes an axially extending projection 20 received within recess 21 in the trailing end of the candy portion 15.

Figure 2:
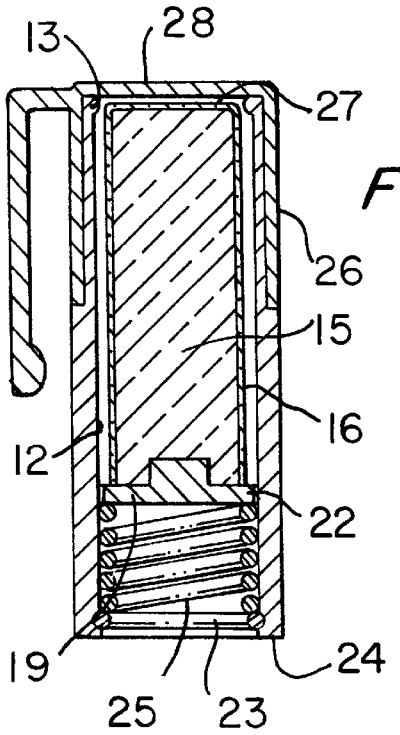
FIG. 2 is a vertical sectional view through a candy device in the closed condition thereof.
Figure 3:
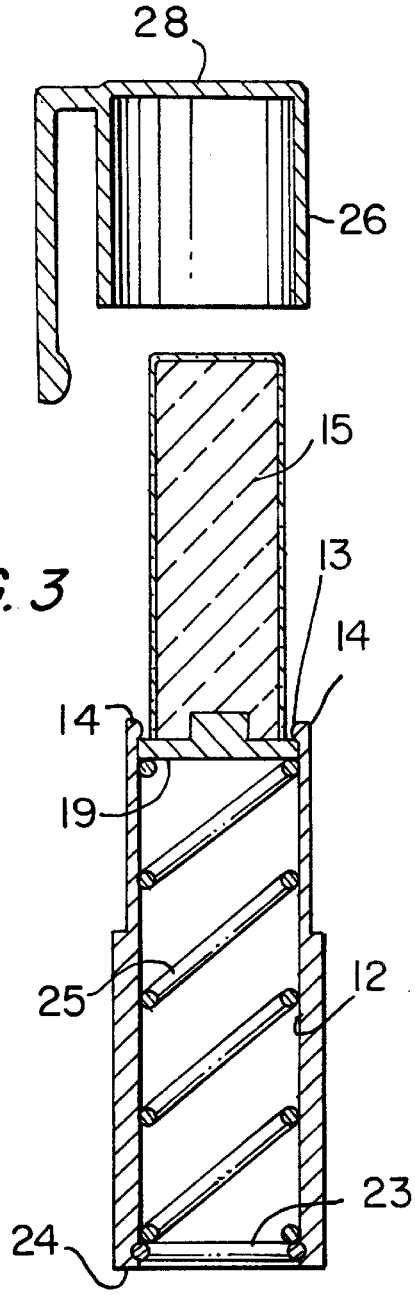
FIG. 3 is a section similar to FIG. 2 showing the position of the parts after removal of the closure cap.

As best appreciated from FIGS. 2 and 3, the radial margin 22 of the valve member 19 projects a distant beyond the radial extent of the candy portion and into close juxtaposition to the interior walls 12 of the barrel 10.

A plug member 23 is forced fittedly mounted within the barrel adjacent the end 24 of the barrel. A coil spring 25 is interposed between the valve member 19 and plug 23, the spring yieldably urging the valve 19 and candy portion toward the mouth 14 of the barrel.

A cap member 26 which is cup shaped in configuration, is mounted over the neck 11 of the barrel, and interlocks therewith preferably with a tight frictional fit which renders the cap 26 resistant to removal from the neck. As will be apparent from FIG. 2, in the seated position of the cap, the spring 25 will urge the upper most end 27 against the top wall 28 of the cap.

Referring now to FIG. 3, when cap 26 is removed spring 25 is free to expand whereby candy portion 15 is projected outwardly through the mouth 14 of the barrel. In this condition, the annular marginal edge 22 of the valve member 19 is yieldingly urged against the rim or valve seat 13 defining a seal at the junction of valve and valve seat.

As will be appreciated from the foregoing, any syrup formed in the course of consuming the candy product will be blocked from entering the interior of the barrel by the interaction of the valve 19 and valve seat 13. It is important to note that the user may employ many cycles of movement between the sealed position of FIG. 2 and the projecting position of FIG. 3 in the course of consuming the candy component. Under the circumstances, the importance of maintaining the ability of the candy component to be freely moved into and out of the barrel will be readily recognized. More particularly, reapplication of the cap, 26 will return the candy portion to the interior of the device. Since shifting movement to the exposed position of FIG. 3 is accomplished solely under the expanding force of spring 25 (which is preferably also made of a polymeric material) the importance of maintaining the interior of the barrel free of syrup is magnified.

While a user of the prior Push Pop product could conceivably, by appropriate manipulation of the candy portion, effect a sealed condition, a sealing action comparable to that of the instant invention does not automatically occur.

As will appreciated from the instant disclosure there is provided in accordance with the invention a novelty candy product capable of a multiplicity of cycles of extension and retraction of the candy component, the likelihood of the candy component "freezing" within the barrel being minimized.

As will be apparent to those skilled in the art and familiarized with the instant disclosure, numerous variations of the illustrated structure may be made without departing from the spirit of the invention. Accordingly, the invention is to be broadly construed within the scope of the appended claims.

What is claimed is:

1. A sanitary novelty candy device comprising a tubular barrel having first and second ends, an open mouth portion at said first end, a closure plug fixedly mounted at said second end, a candy assembly slidably mounted in said barrel, said assembly including a hard candy portion; said candy portion including a lead end adjacent said mouth portion and a trailing end in proximate spaced relation to said plug, a valve member bonded to and projecting radially beyond said trailing end of said candy portion, coil spring means interposed between said plug and said valve member for biasing said valve member and candy portion toward said first end of said barrel, a valve seat formed on the interior of said barrel adjacent said mouth portion, a hollow cup shaped cap member removable mounted over said mouth portion, said valve member being projected by said spring means into sealing relation of said valve seat responsive to removal of said cap member from said mouth portion.

2. A candy device in accordance with claim 1 and including interlocking means interposed between said cap and said neck for releasable securing said cap to said barrel.

3. A candy device in accordance with claim 1 wherein said barrel is cylindrical and said valve seat comprises a rim projecting interiorly of said barrel.

* * * * *